United States Patent [19]

Jennings

[11] 3,972,283

[45] Aug. 3, 1976

[54] REMOVABLE IMPRINTER WITH LATCH FOR BURSTER

[75] Inventor: Lewis F. Jennings, McHenry, Ill.

[73] Assignee: Uarco Incorporated, Barrington, Ill.

[22] Filed: Sept. 16, 1974

[21] Appl. No.: 506,187

[52] U.S. Cl. ..... 101/226; 101/216

[51] Int. Cl.[2] ..... B41F 13/56; B41F 5/04

[58] Field of Search ..... 101/2, 212, 216, 228, 101/232, DIG. 19, 93.07, 226, 227

[56] References Cited

UNITED STATES PATENTS

| | | | |
|---|---|---|---|
| 3,229,631 | 1/1966 | Peterson | 101/228 |
| 3,231,268 | 1/1966 | Pine et al. | 271/88 |
| 3,493,156 | 2/1970 | Absler et al. | 225/100 |
| 3,828,673 | 8/1974 | Gazzola | 101/232 |

*Primary Examiner*—Edgar S. Burr
*Assistant Examiner*—R. E. Suter
*Attorney, Agent, or Firm*—Wegner, Stellman, McCord, Wiles & Wood

[57] ABSTRACT

An improved burster for separating continuous business forms stationery assemblies into individual form lengths of the type including an infeed mechanism for driving the continuous assembly into a burster which, in turn, separates the assembly into individual form lengths which are placed on a conveyor to be conveyed to a stacking tray. The burster includes a powered mechanism whereby the burster, the conveyor, and a portion of the stacking mechanism may be simultaneously adjusted for various form lengths. Also incorporated is an automatic electrical system responsive to such adjustment for automatically adjusting the conveying rate of the conveyor to insure proper shingling of the individual form lengths thereon. The burster is in a housing having a movable cover whereby access to the various mechanisms may be obtained. A control system provides for jogging of the mechanisms with the cover open that precludes continuous operation for safety purposes. A printer assembly may be optionally used with the burster and includes interlocks with the cover whereby the printer assembly is locked in place responsive to moving the cover to a closed position. A vertically movable stacking tray is employed and a sensing device is operative to cause the tray to move upwardly or downwardly responsive to the position of forms thereon. The control system also provides for control of other business forms equipment employed in line with the burster.

3 Claims, 14 Drawing Figures

332
324
408
406
260
370
372
392
394
410
374
4 CR
6 CR
3 CR
2 CR
12 CR
7 CR
5 CR
13 CR
1 CR
11 CR
8 CR
368
404
362
412
412a
376
188
115v 60Hz
320
402
346
368a
370a
374b
334
348
336
364
344
410a
338
400
352
366
340
342
350
362a
362b
360
370b
330
368b 332
458
START
456
450
STOP
394c
318
356
358
284
280
SYSTEM
452
454
392c
394d
330

REMOVABLE IMPRINTER WITH LATCH FOR BURSTER

BACKGROUND OF THE INVENTION

This invention relates to bursters for continuous business forms stationery assemblies. Relevant prior art includes U.S. Pat. Nos. 3,229,631 to Peterson; 3,231,268 to Pine et al; and 3,493,156 to Absler et al.

Increasing labor costs have caused a variety of businesses to seek more automated ways of handling various facets of their operations, including the handling of paper work, payrolls, etc. As a result, there has been a considerable upsurge in the popularity of continuous business forms assemblies by reason of their adaptability to automated equipment.

Typically, continuous business forms assemblies are comprised of one or more elongated webs of paper provided with transverse lines of weakening defining individual form lengths. When the continuous business forms assembly has been substantially processed, as by the imprinting of information thereon, it is frequently desirable to break the assembly down into individual form lengths for distribution, mailing, or the like.

As is well known, a burster is employed for the purpose of separating the assembly into individual form lengths. Bursters commercially available today have generally been acceptable for their intended purpose and this is true of the burster described in the previously identified U.S. patents. However, with the ever-present desire for increased automation, coupled with present-day desires for maintaining safe conditions for an operator of such equipment, there remains a real need for a new and improved bursting apparatus.

SUMMARY OF THE INVENTION

It is the principal object of the invention to provide a new and improved burster. More specifically, it is an object of the invention to provide a highly automated burster requiring a minimum of operator supervision to reduce labor costs, and one which maximizes the safety of operation.

The exemplary embodiment of the invention achieves the foregoing objects in a burster structure of the type having a housing containing means defining a path of stationery travel therethrough from an infeed end to an outfeed end. Adjacent the infeed end there may be provided tractor-trimmer mechanisms for driving a continuous business forms assembly into the burster. Along the path of stationery travel from the infeed end, there may be optionally located an imprinter assembly for printing on the continuous forms assembly prior to the bursting of the same. Subsequent to the printing assembly and along the path of stationery travel is a burster mechanism for separating the business forms assembly into individual form lengths.

The burster is followed by a conveyor which receives the individual form lengths in shingled relation and conveys the same to a stacking mechanism and shelf located at the outfeed end of the burster.

The housing has an opening whereby access to the foregoing components may be achieved. The opening is provided with a slidable cover and an interlock is associated with the cover whereby the mechanism cannot be operated continuously, as during a bursting run, unless the cover is fully closed.

The printing assembly is removable for optional use and includes latches for latching the same in place. The latches are manually actuated and include handle members disposed in the path of the cover so that after the printer is located in the housing, upon-closing the cover, the latches will automatically be engaged if they have not been previously manually engaged.

Other objects and advantages will become apparent from the foregoing specification taken in conjunction with the accompanying drawings.

DESCRIPTION OF THE PREFERRED EMBODIMENT

Figure 1:
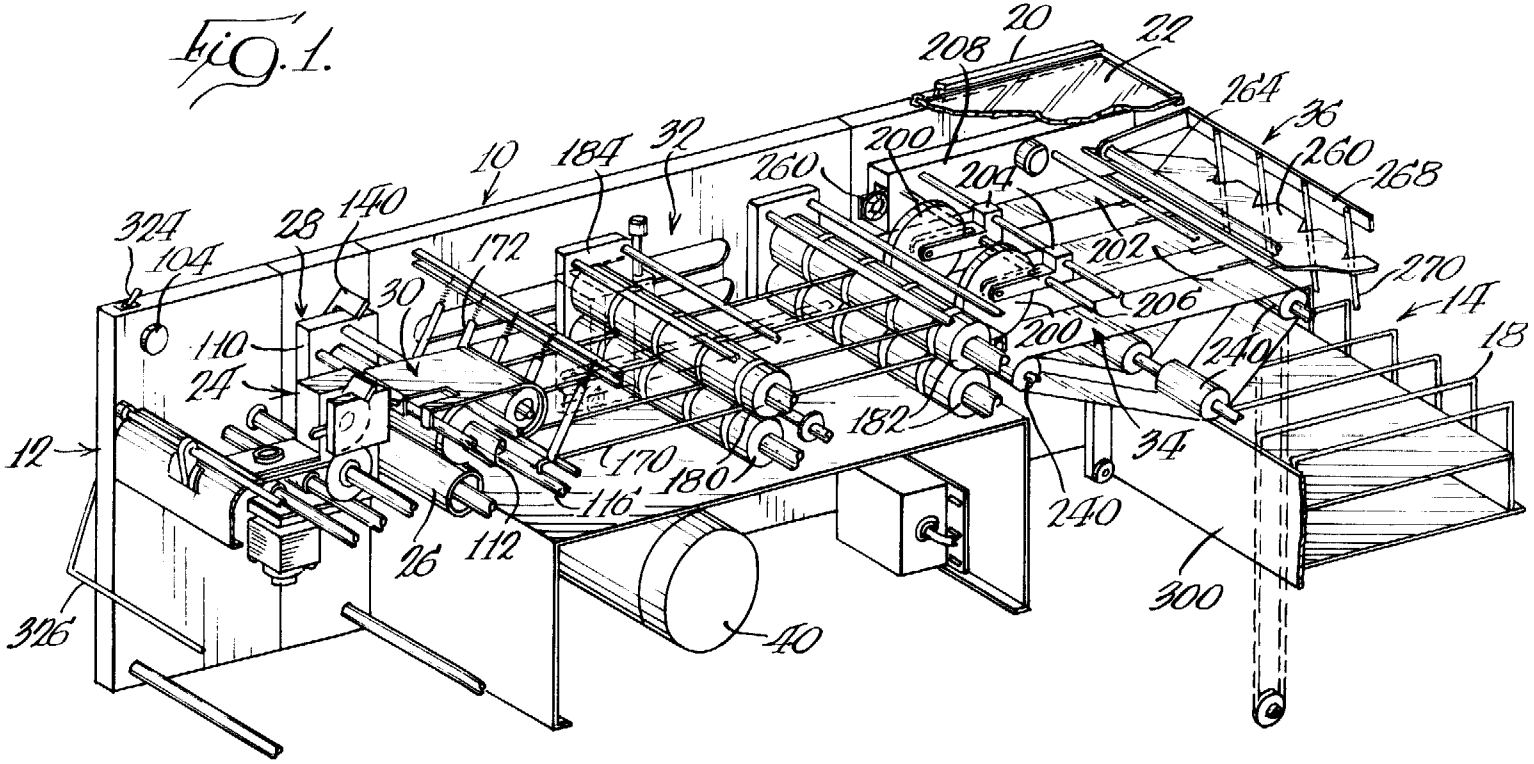
FIG. 1 is a perspective view of a burster made according to the invention with parts broken away for clarity.
Figure 2:
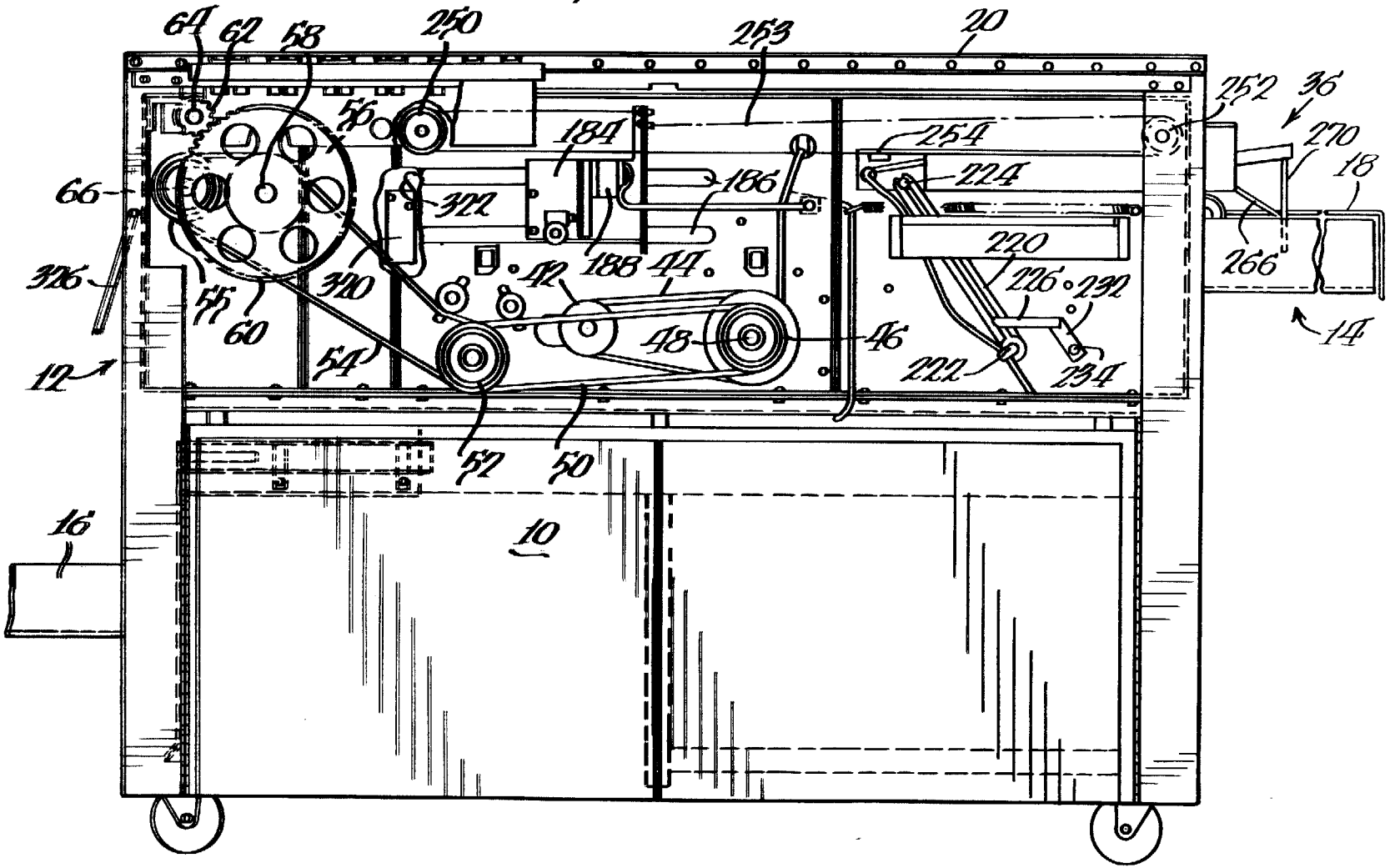
FIG. 2 is a side elevation of the burster with certain components removed to illustrate drive mechanisms.

An exemplary embodiment of a burster made according to the invention is seen in the drawings and with reference especially to FIGS. 1 and 2, is seen to include a housing, generally designated 10, having an infeed end, generally designated 12, and an outfeed end, generally designated 14.

The housing 10 contains various components to be described in greater detail hereinafter, which components define a path of stationery travel from an infeed shelf 16 located at the infeed end 12 to a stacking shelf 18 at the outfeed end 14. Preferably, the shelf 18 is fabricated from a plurality of bails as disclosed more fully in the previously identified Absler et al patent.

The housing 10 is open at its top, as best seen in FIG. 1, and opposite sides thereof are provided with inwardly opening channels 20 (only one of which is shown) for sliding receipt of a glass cover member 22. By sliding the cover 22 within the channels 20, the housing 10 may be opened or closed so as to allow the operator to achieve access to the bursting components for set-up purposes or, upon such occurrence, clearing a jam.

With reference now to FIG. 1, adjacent the infeed end 12 and within the housing 10 are two tractor trimmer assemblies, generally designated 24, which are made according to the teachings of the commonly assigned Stromberg application Ser. No. 495,065, entitled "Trimmer Blade Throwoff Mechanism", filed Aug.

5, 1974, now U.S. Pat. No. 3,905,262 issued Sept. 16, 1975.

Preferably, the tractor-trimmer assemblies 24 are fabricated according to the second embodiment disclosed in the Stromberg application so as to provide the capability in the burster of margin breaking. Moreover, provision is made according to the Stromberg application for independent adjustment of each of the tractor-trimmer assemblies 24 laterally of the stationary path to accommodate forms of differing widths.

Forms exiting the tractor-trimmer assemblies 24 are directed to a friction drive infeed roller 26. The roller 26 provides a friction drive for the forms and is particularly useful when the forms to be burst are not provided with control punch margins so that they cannot be driven into the burster by the tractor portion of the tractor-trimmer assemblies 24.

The roller 26 also serves as an impression roller for a removable printing assembly, generally designated 28. As will be seen, the printing assembly 28 can be easily located in the apparatus when printing on forms is desired and just as easily can be removed therefrom.

Forming a portion of the printing assembly 28 is a removable inking assembly, generally designated 30 to be described in greater detail hereinafter.

After passing over the roller 25, the forms are fed into the bursting section of the machine which is generally designated 32. In the bursting section 32, the continuous business forms assembly is separated into individual form lengths which are directed to a conveyor, generally designated 34, whereon they are accumulated in shingled relationship. The conveyor 34 in turn moves the individual forms to a deflecting structure, generally designated 36, which in turn directs the forms to the stacking tray 18 for receipt thereon in stacked relation.

Driving power for the tractor-trimmer assemblies 24, the printer 28, and the bursting section 32 is provided by a main drive motor 40 suitably mounted within the housing 10. As best seen in FIG. 2, the motor 40 drives a sheave 42 which, by means of a belt 44, drives a double sheave 46 on a shaft 48. The shaft 48 in turn provides rotary power to the bursting section 32.

A belt 50 reeved about the double sheave 46 drives a double sheave 52. A belt 54 extends from the sheave 52 to a sheave 55 and a sheave 56. The sheave 56 is mounted on a shaft 58 which in turn mounts a gear 60 in mesh with a gear 62 on a shaft 64. The sheave 55 is on a shaft 66.

Figure 3:
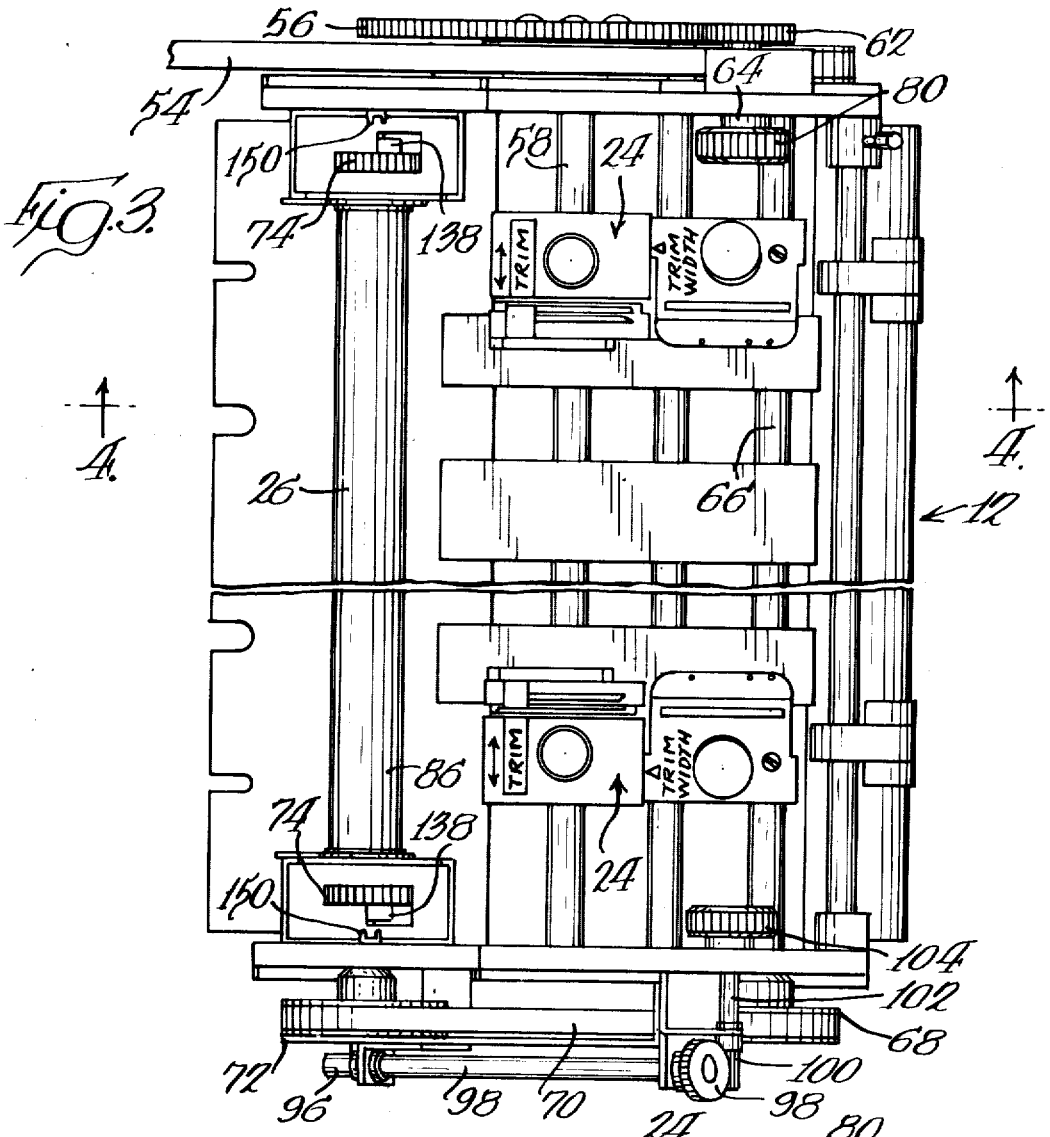
FIG. 3 is a plan view of a portion of the infeed end of the burster.

The shaft 66 drives the tractor elements in the tractor-trimmer assemblies while the shaft 58 drives the trimmers in the tractor-trimmer assemblies 24. As seen in FIG. 3, at the opposite side of the housing, the shaft 66 mounts a sheave 68 which, by means of a belt 70, drives a sheave 72 which in turn is connected to the infeed drive roller 26 to drive the same.

On opposite sides of the infeed roller 26, and adjacent the sides of the housing 10 on the interior thereof, gears 74 are disposed for rotation with the roller 26 and are adapted to be engaged with gears on the printing unit 28 as will be described in greater detail hereinafter.

Within the housing 10 is a knob 80 which is associated with the shaft 64. The arrangement is such that the knob is actually movable on the shaft 64 and in one position thereon is in driving engagement with the shaft. In another position, the knob 80 is declutched from the shaft 64. Switch means (not shown in FIG. 3) are provided for signalling when the knob 60 is coupled to the shaft 64.

During setup, the knob 80 may be moved to a position wherein it is coupled with the shaft 64 and then manually rotated to rotate the various driving components through the foregoing drive system to aid in setup.

Figure 4:
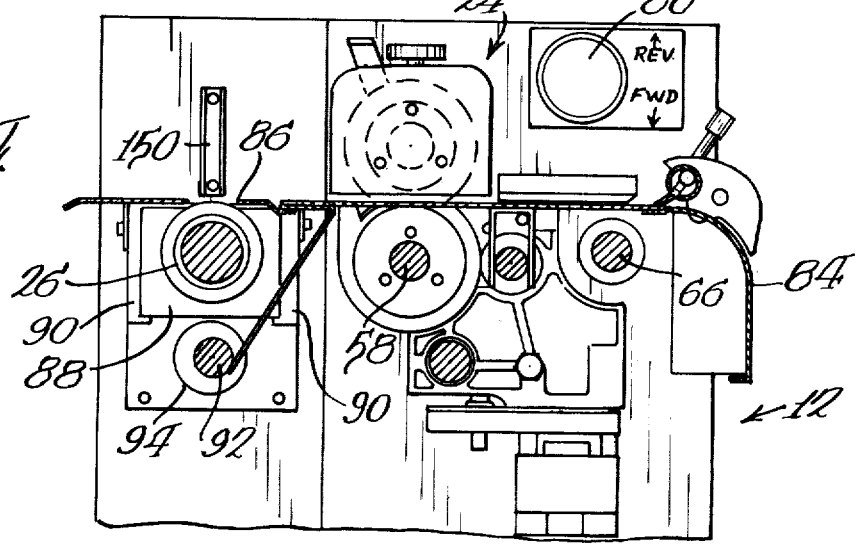
FIG. 4 is a vertical section taken approximately along the line 4—4 of FIG. 3.

As can be seen in FIGS. 3 and 4, the infeed end 12 of the burster includes sheet metal surfaces 84 which, together with components heretofore and hereinafter described define the path of stationery travel. At one point, an opening 86 is provided so that a portion of the roller 26 may project slightly thereabove to engage stationery travelling in the path. It is desirable that the position of the roller 26 within the opening 86 be adjustable so as to insure proper engagement of the roller 26 with stationery travelling the path and, when used in connection with the printer assembly 28, to regulate the degree of impression of the printer on the forms. In this connection, it will be recalled that the roller 26 is also employed as an impression roller for the printer.

To this end, roller 26 is journalled in bearing blocks 88 (only one of which is shown) which in turn are mounted for movement in a vertical direction by guides 90. A shaft 92 is journalled at opposite sides of the housing 10 and mounts in a eccentric 94 at each end which is in engagement with a corresponding one of the bearing blocks 88.

One end of the shaft 92 mounts a spur gear (not shown) which is in engagement with a worm gear 96 (FIG. 3) mounted on the end of a shaft 98. The end of the shaft 98 opposite the gear 96 mounts a spur gear 98 in engagement with a worm gear 100 which in turn is mounted on a shaft 102. The shaft 102 extends into the interior of the burster and mounts a knob 104. Thus, through rotation of the knob 104, the shaft 92 may be rotated to rotate the eccentrics 94 and thereby raise or lower the roller 26 with respect to the opening 86.

With reference now to FIGS. 1 and 3–7, the removable printer assembly 28 will be described in greater detail. The same includes a frame defined by a pair of end members 110 interconnected by three shafts 112, 114 and 116. The length of the shafts 112, 114 and 116 is such that the frame spans the interior width of the burster.

Figure 6:
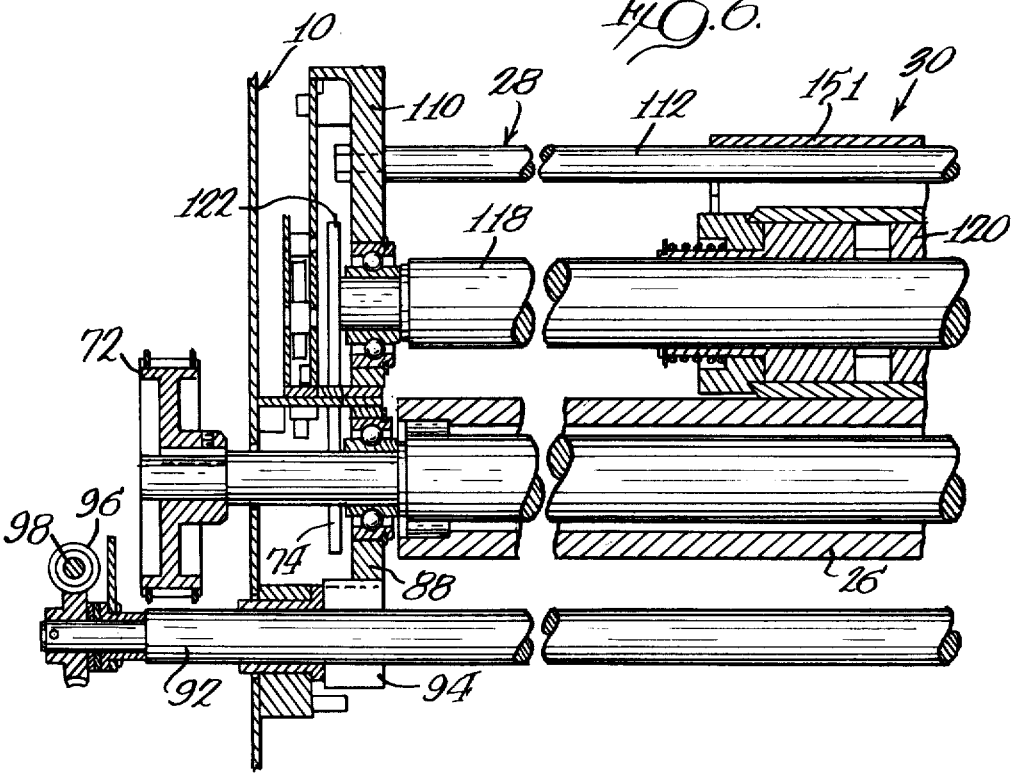
FIG. 6 is a vertical section taken approximately along the line 6—6 of FIG. 5.

A shaft 118 extends between the end members 110 and is journalled therein. The shaft 118 mounts a printing roll 120 of any desired construction which, as seen in FIG. 6, is in sufficient proximity to the roller 26 so as to sandwich stationery sufficiently to impart the indicia carried by the cylinder 120 onto the stationery. As will be apparent to those skilled in the art, printing can be by means of inked indicia on the cylinder 120 or by so-called "crash imprinting".

One end of the shaft 118 mounts a gear 122 which is adapted to engage one of the gears 74 when the printer 28 is located within the burster.

Each of the end members 110 carries a movable latch assembly defined by a latch element or lever 130. The lever 130 includes an elongated, arcuate slot 132 intermediate its ends for receipt of a pin 134. The end of the lever 130 below the slot 132 includes a hook-like latching portion 136 which is adapted to be latched about a pin 138 secured to the housing when the lever 130 is in the solid line position illustrated in FIG. 5.

The end of the lever 130 opposite the latch end 136 includes a handle 140 whereby the printing assembly 28 can be manually latched in place.

Figure 5:
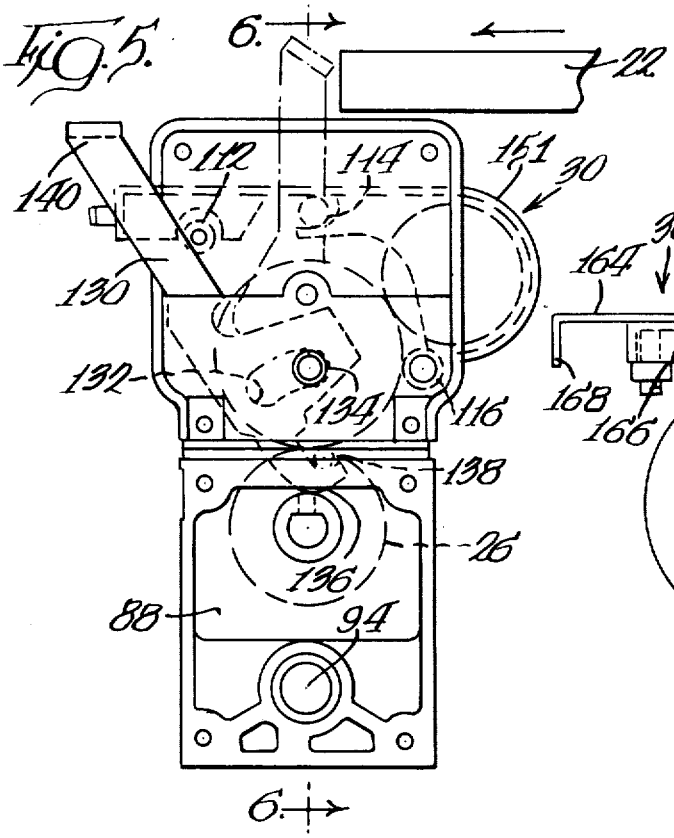
FIG. 5 is an enlarged view of a printing assembly that may be employed with the invention.

As seen in FIG. 5, the latch lever 130 is movable to a dotted line position whereat the handle end 140 extends sufficiently high above the end plate 110 to be engaged by the cover 22 when the latter is moved to the left as viewed in FIG. 5, i.e., toward the infeed end 12.

As a consequence of this construction, should the printer 28 be placed in the burster but not firmly latched therein through inadvertence, when the cover 22 is closed, it will strike the latches and move the same to the solid line position shown in FIG. 5 thereby firmly latching the printing assembly in place.

Moreover, as will be seen, the burster cannot be run continuously without the cover 22 being in a closed condition. Thus, this construction insures that the printer assembly 28 will be locked in place at all times when the burster is being operated continuously.

As can be seen in FIGS. 3 and 4, guide channels 150 may be disposed within the burster housing 10 for receipt of suitable pins (not shown) for guiding a paper hold-down roller assembly (not shown) into the proper location when the printing assembly 28 is not used.

FIGS. 1 and 5–7, inclusive, also illustrate the removable inking assembly 30 in greater detail. The same includes a housing 151 having a bulbous portion for removable receipt of an inking roll 152 journalled on a shaft 154. Any suitable latch 156 pivoted to the housing by a pin 158 may be employed to bear against the shaft 154 to firmly locate the inking roll 152 within the housing. Preferably, two latches 156 are provided, one on each side of the housing.

The housing also includes a hook-like formation 160 which may be hooked about the shaft 114 defining a part of the frame for the printer assembly 128. The housing sidewalls also include a semicircular recess 162 in which the shaft 112 may be partially received.

A latch member 164 is journalled in the housing in any suitable fashion and includes a hook-like end 166 disposed for rotation about an axis concentric with the longitudinal axis of the shaft 112 when the housing 150 is mounted on the printing assembly 28. In such a disposition, the hook-like end opens downwardly for free receipt of the shaft 112.

The latch member 164 at the end opposite the hook-like member 166 includes a handle 168. When the handle 168 is disposed in the solid line position shown in FIG. 7, the hook-like end portion 166 will be disposed about a portion of the lower side of the shaft 112 to firmly latch the inker 30 in place. When moved to the dotted line position shown in FIG. 7, the inker 130 may be placed on the frame of the printer 28 or removed therefrom.

Figure 7:
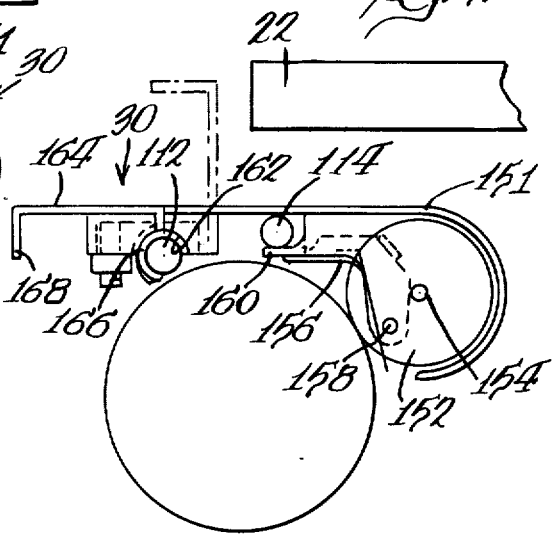
FIG. 7 is a fragmentary side schematic of an inker assembly.

It will also be observed from FIG. 7 that when the handle 168 is in the dotted line position, corresponding to an unlatched condition allowing removal of the inker 30, it is in a position to be engaged by the cover 22 when the latter is moved to the left toward the infeed end of the burster. Upon being so engaged, further movement of the cover 22 will cause the latch 164 to move to the solid line position of FIG. 7. Consequently, the burster cannot be run continuously with the inker 130 in an unlatched condition on the printer 28.

Returning now to FIG. 1, as continuous forms exit the printer 28, they are directed to guide structures 170 forming part of the bursting section 32 of the burster. The guide structures 170 preferably include resiliently supported bands 172 as is well known.

The stationery is guided by the guide structure 170 to a first set of bursting rolls 180 which are driven at a first peripheral rate of speed. From the first set of rolls 180, the guide structure 170 directs the stationery to a second set of burster rolls 182 which are driven at a faster peripheral rate of speed than the rolls 180, as is well known. This relationship causes the continuous forms assembly to separate into individual form lengths along the transverse lines of weakening therein.

To accomodate continuous forms assemblies having differing form lengths, one set of the burster rolls is movably mounted with respect to the other in a direction parallel to the path of stationery travel. In the preferred embodiment, the first set of bursting rolls 180 is so mounted by means of a suitably formed carriage 184.

Figure 8:
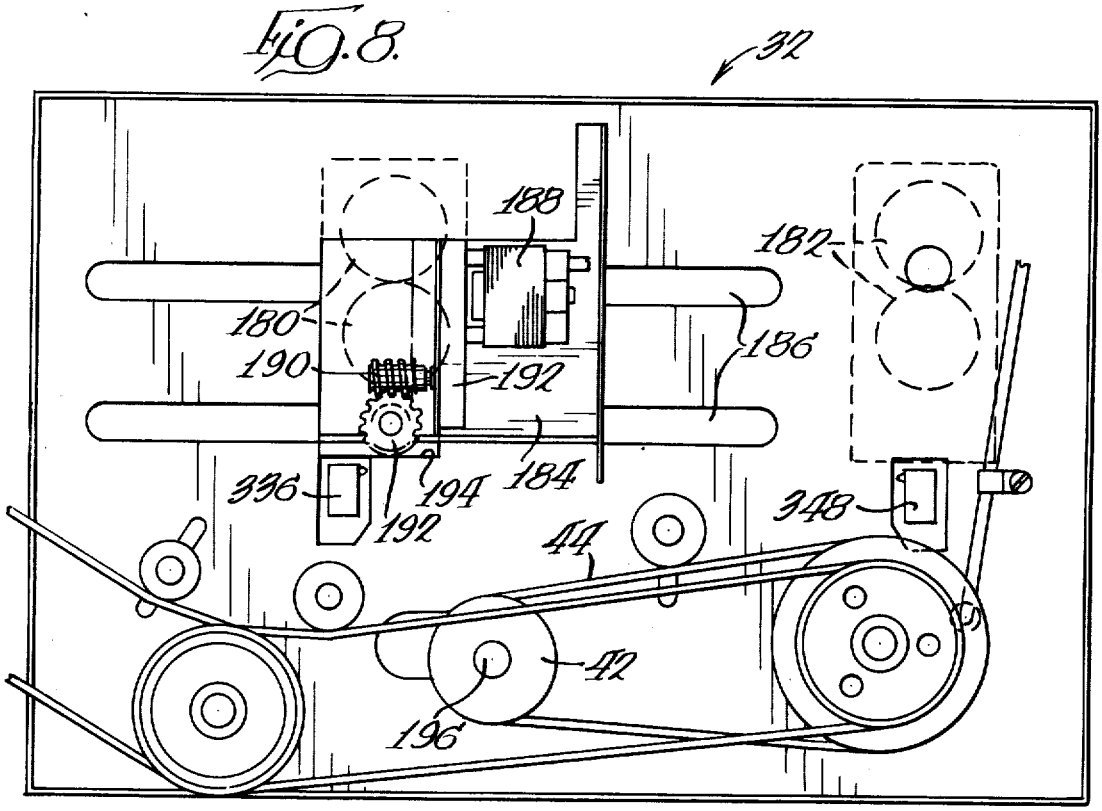
FIG. 8 illustrates a portion of the burster mechanism and adjustment structure.

As best seen in FIGS. 2 and 8, the innermost sidewalls of the housing 10 are provided with elongated slots 186 through which shafts mounting the bursting rolls 180 extend, the slots 186 allowing the aforementioned movement of the bursting rolls 180. On one side of the structure, the carriage 184 mounts a motor 188 which drives a worm gear 190 via a reduction gear train 192. The worm gear 190 is in turn meshed with a spur gear 192 which is meshed with a rack schematically shown at 194 in FIG. 8.

As a result of the foregoing construction, the bursting rolls 180 may be moved toward or away from the bursting rolls 182 to accomplish adjustment for differing form lengths.

As mentioned previously, the burster section 32, and specifically the rolls 180 and 182, are driven by the sheave 42. Any suitable connection may be established between a shaft 196 driven by the sheave 42 to the shafts mounting the rollers 180 and 182 such that at least one roller in each pair is driven with the proper peripheral speed rate relation mentioned previously. For example, a drive system including a linkage such as that shown in Absler et al U.S. Pat. No. 3,493,156 may be employed for this purpose.

Returning again to FIG. 1, as the stationery emerges from the second set of burster rolls 182, the same will be in individual form lengths and will be directed to a nip defined by plural rollers 200 overlying continuous belts 202 forming part of the conveyor 34. The rollers 200 are suitably journalled by brackets 204 which are slideable, for adjustment purposes, on cross members 206 affixed to the side members 208 of a carriage. The nip defined by the rollers 200 and the belts 202 functions to properly locate the individual form lengths in shingled relation on the belts 202 for ultimate conveying to the stacking tray 18.

A carriage including the side members 208 is suitably mounted within the housing for back and forth movement parallel to the path of stationery travel therethrough. The purpose is to provide for adjustment of the conveying section 34 to accommodate differing individual form lengths in the continuous forms assembly being burst by changing the location of the nip provided by the rollers 200 and the belts 202 with respect to the endmost pair of bursting rolls 182.

Figure 9:
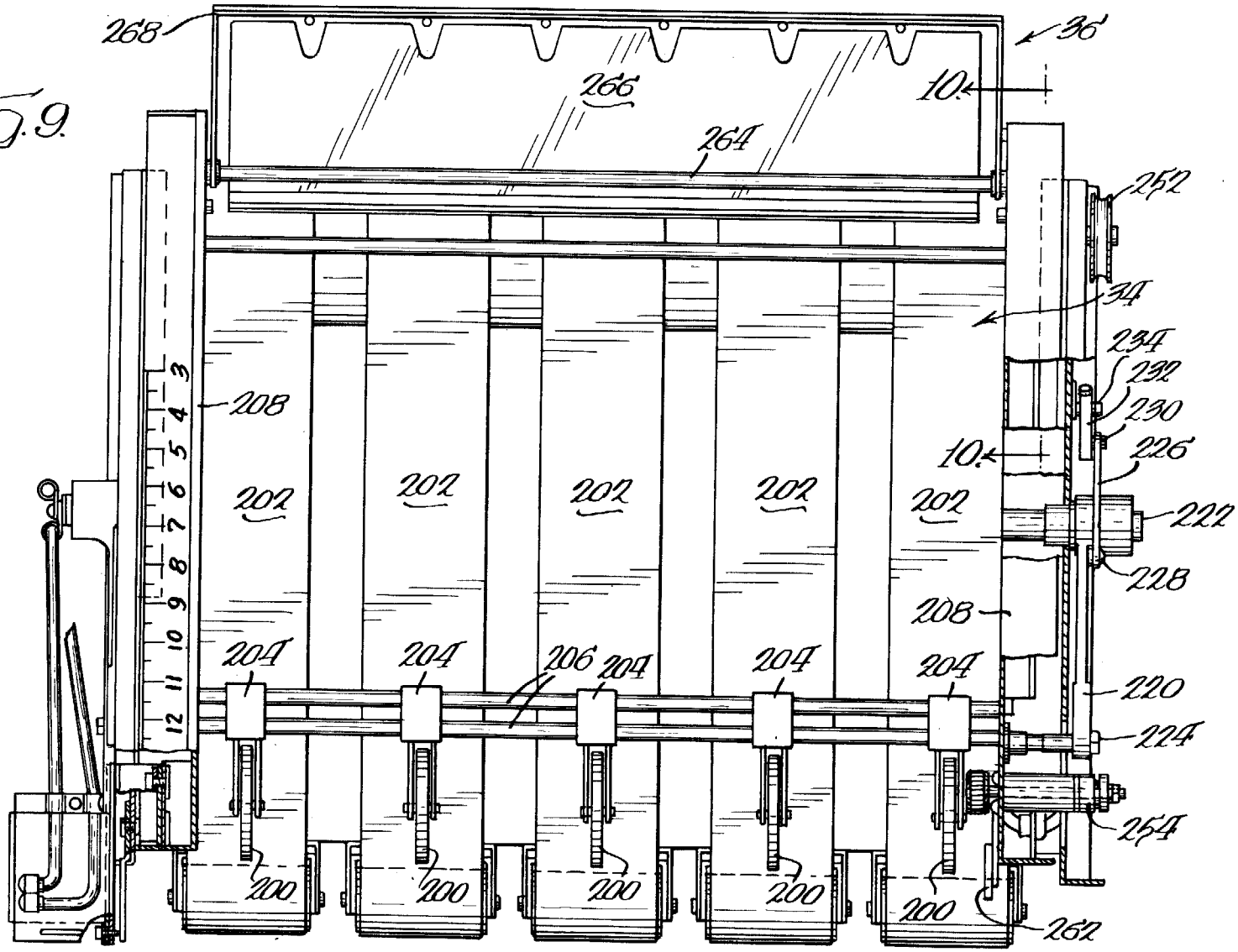
FIG. 9 is a plan view of a conveyor and a portion of a stacking mechanism.

As seen in FIGS. 2 and 9, an elongated arm 220 is journalled as at 222 to the housing 10. The upper end of the arm 220 is pivotally and slideably connected by means including a bolt 224 to one of the side members 208. Consequently, as the carriage including the side members 208 is moved back or forward above the conveyor belts 202, the position of the arm 220 will shift about the pivot point 222.

A link 226 is pivotally connected by a pin 228 to the arm 220 just above the pivot 222 and in turn is pivotally connected by a pin 230 to a link 232. The link 232 is in turn rigidly affixed to the wiper shaft 234 of a potentiometer 236 (FIG. 12) for purposes to be described in greater detail hereinafter.

The conveyor assemblage 34 is completed by rollers 240 suitably journalled and about which the belts 202 are trained. One set of the rollers 240 is suitably driven by a motor 242 (FIG. 12) so as to cause the upper runs of the belts 202 to move from left to right as viewed in FIG. 1.

As mentioned, the carriage defined by the side members 208 is movable toward and away from the last set of burster rolls 182. According to the invention, such movement is powered. With reference to FIGS. 2 and 9, there will be seen sheaves 250 and 252 suitably journalled to the housing 10. With reference specifically to FIG. 2, a cable 253 is secured by any suitable means to the carriage 184 which, it will be recalled, is movable with the first set of bursting rolls 180, and is trained about sheaves 250 and 252. A connecting bracket 254 is secured to one of the side members 208 and additionally is connected to the cable 253. Consequently, when the carriage 184 is driven in one direction or the other by the motor 188, the carriage side members 208 will be moved in the same direction by an equal amount.

If desired, suitable provision may be made in connection with the bracket 254 to provide a fine adjustment for orienting the carriage side members 208 with respect to the bursting rolls.

Returning to FIG. 1, it will be seen that one of the side members 208 carries an optical sensor 260 which is a combined light source and photo cell. With reference to FIG. 9, the opposite side member 208 carries a reflective surface 262. Consequently, light generated by the optical sensor 260 will normally be directed across the burster just above the path of stationery travel to impinge upon reflective surface 262 to be redirected to the photo cell part of the optical sensor 260. As will be seen, this structure is employed as a jam detector for the purpose of sensing when the individual form lengths are not in proper shingled relation on the conveyor 34.

FIGS. 1, 2 and 9 illustrate the paper deflecting structure 36 in greater detail. A shaft 264 is journalled in the end members 208 and carries a vane 266 which is located to engage the top of a stack of individual form lengths received on the stacking tray 18. Also carried by the side members 208 is a fork-like structure 268 having downwardly extending tines 270. As the individual form lengths leave the conveyor 34, they impinge against the vane 266 and the tines 270 and the two act to properly vertically stack the individual form lengths on the tray 18.

The vane 266, in addition to orienting the forms on the tray 18, serves as a sensor for determining the position of the topmost one of the forms in the stack with relation to the end of the conveyor 34 for purposes to be described in greater detail hereinafter.

Figure 10:
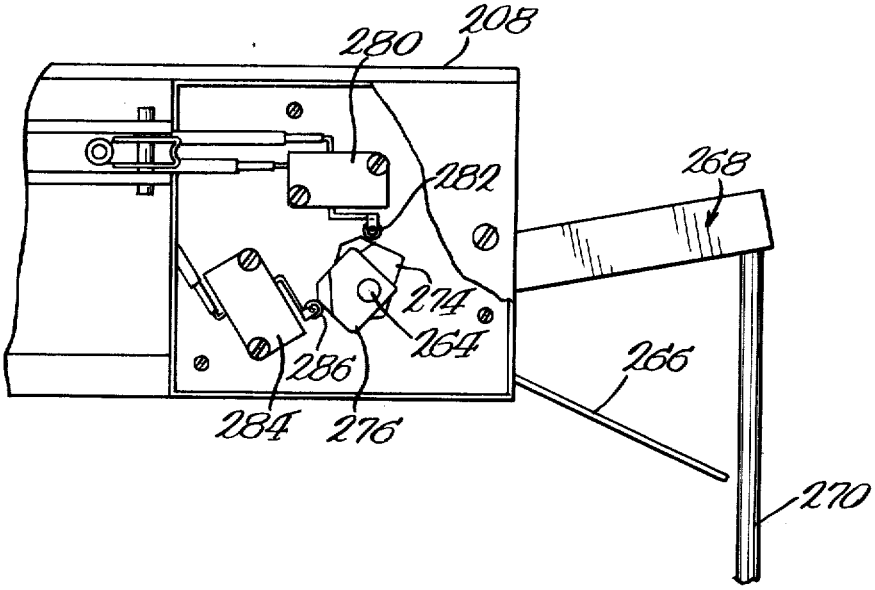
FIG. 10 is an enlarged, fragmentary view of a control segment of the stacker mechanism.

With reference to FIG. 10, a portion of the shaft 264 extends through one of the end members 208 and mounts a pair of cams 274 and 276 for rotation therewith. Secured to the end member 208 is a first microswitch 280 having an actuator 282 contacting the cam 274 and a further microswitch 284 having an actuator 286 in contact with the cam 276 is also provided.

The position of the cams 274 and 276 with respect to the actuators 282 and 286, respectively, is such that when the endmost form in the stack is too close to the end of the conveyor for proper stacking, one of the switches 280 and 284 will be closed by reason of the vane 266 moving upwardly about the pivot axis defined by the shaft 264. On the other hand, if the topmost form on the stack is too far from the conveyor for proper stacking, the vane 266 will shift downwardly thereby rotating the cams 274 and 276 in the other direction closing the other one of the switches 280 and 284. It is also to be noted that the cams and switches are arranged such that when the vane 266 senses that the topmost form in the stack is in the proper position with respect to the conveyor for optimum stacking, neither switch 280 or 284 will be closed.

Figure 11:
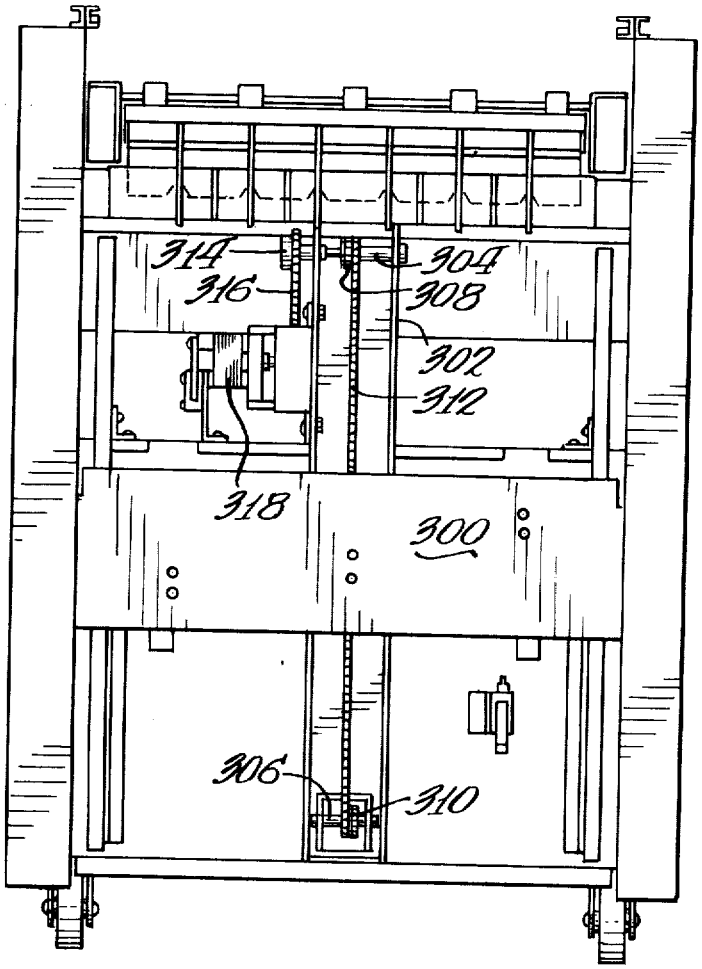
FIG. 11 is a rear elevation of the burster with certain parts removed for clarity.

Referring now to FIGS. 1 and 11, a plate 300 is suitably mounted for up and down movement within the housing 10 adjacent the outfeed end. Suitable rollers and tracks may be employed in mounting the plate 300 for this purpose. The stacking tray 18 is secured to the plate 300 by any suitable means so as to be movable therewith.

A vertical frame member 302 (FIG. 11) journals shafts 304 and 306 at its opposite ends. The shaft 304 mounts a sprocket 308 while the shaft 306 mounts a sprocket 310 and the sprockets 308 and 310 have a chain 312 trained thereabout. The chain 312 is in turn secured to the plate 300.

The shaft 304 mounts a further sprocket 314 which by means of a chain 316 is connected to a sprocket (not shown) on the output shaft of a reversible electrical motor 318 suitably mounted on a frame member within the housing. As a result of the foregoing construction, energization of the motor 318 in one direction will drive the plate 300, and thus the stacking tray 18, upwardly while reverse energization will cause downward movement of the stacking tray 18. As will be seen, the motor 318 is controlled by the position of the vane 266 to position the stacking tray 18, throughout a bursting run, in an optimal position so that the uppermost form on the stack will be in the proper position to receive the next form from the conveyor and accomplish proper stacking. It is to be noted that both up and down control modes are provided so that, if in the midst of a bursting run, the burster is temporarily stopped and forms removed, there will be automatic repositioning of the stacking shelf 18 by upward movement thereof for proper receipt of forms once the burster is again energized without any special attention by the operator.

FIG. 2 also illustrates the provision of means for determining when the last form in a continuous form assembly is passing through the bursting section 32. A switch 320 is suitably secured to the frame within the housing and includes a finger-like actuator 332 which extends into the path of stationery travel. When stationery is in the travel path, the actuator 332 will be rotated approximately 90° clockwise from the position illustrated in FIG. 2 to cause the switch 320 to assume one condition. When the last form has passed the switch, the actuator 332 will return to the position shown in FIG. 2 to change the condition of the switch 320. Preferably, at least two of the switches 320 are employed in spaced relation across the path of stationery travel. The same are included in an electrical control circuit to be described hereinafter.

With reference to FIG. 1, near the infeed end 12 of the burster, a switch 324 is mounted so as to have its actuator disposed in the path of the cover 22. The arrangement is such that only when the cover 22 is fully closed will the switch 324 be tripped. As will be seen, the switch 304 is employed in an interlock to preclude continuous running of the burster except when the cover 22 is fully closed for safety purposes.

FIGS. 1 and 2 also illustrate the provision of a dancer arm in the form of a bale 326 pivotally connected to the burster housing. When the burster is employed in line with other business processing equipment, such as a deleaver, and is receiving a form therefrom, the form will be disposed below the bale 326 before being directed into the infeed end of the burster. Consequently, if the burster is running faster than the upstream equipment, the bale 326 will be pivoted in a clockwise direction as viewed in FIGS. 1 and 2 by the increasing tautness of the form. On the other hand, if the burster is processing the form at a lesser rate than the upstream equipment, the bale 326 will move downwardly to approximately the position shown in FIGS. 1 and 2. By means of an electrical circuit to be described in greater detail hereinafter, the bale position is employed to control operation of the burster.

Figure 12A:
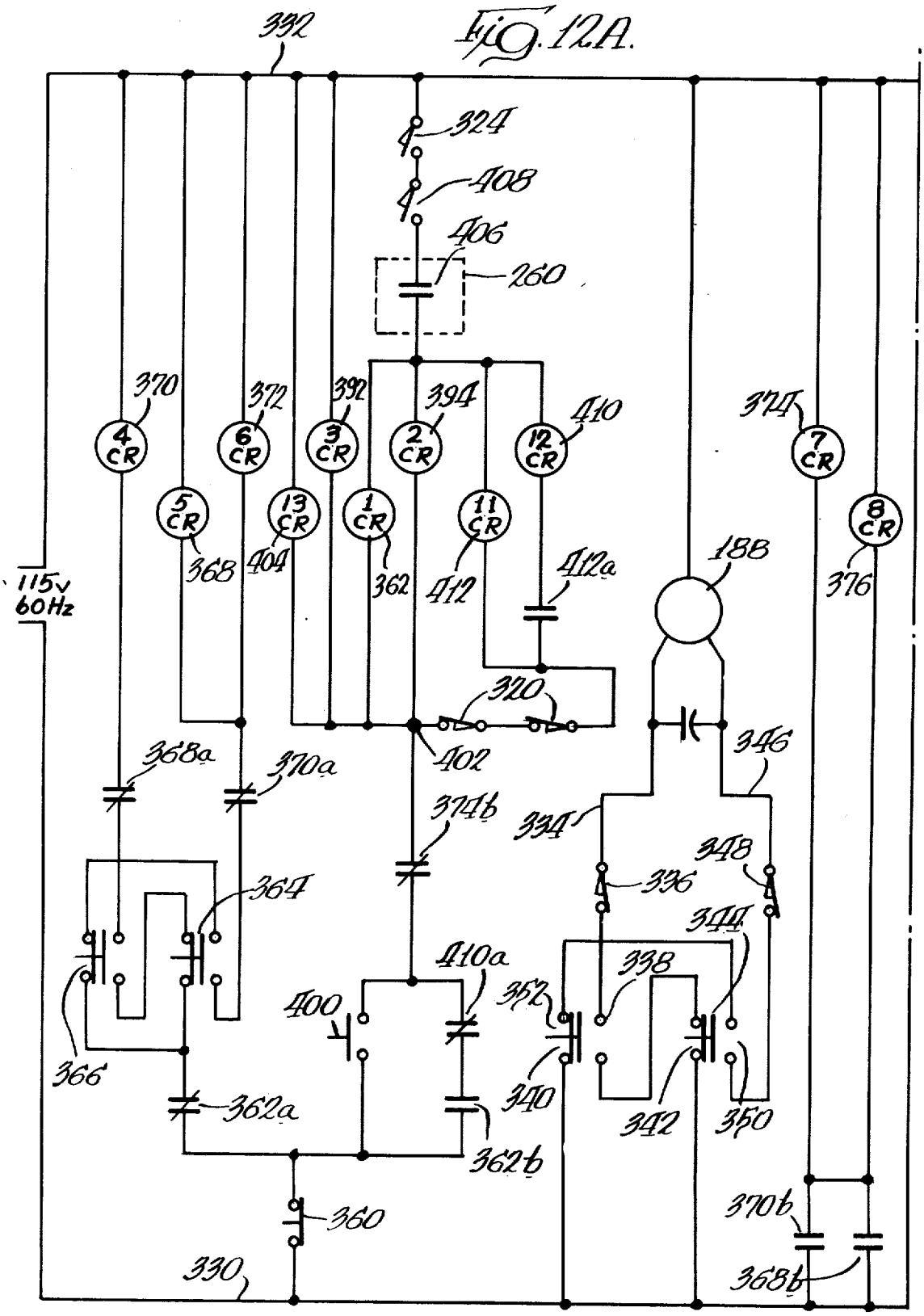
FIG. 12 is a schematic of an electrical control system for the burster and is composed of FIGS. 12A, 12B and 12C, which are to be placed together in order from left to right.
Figure 12B:
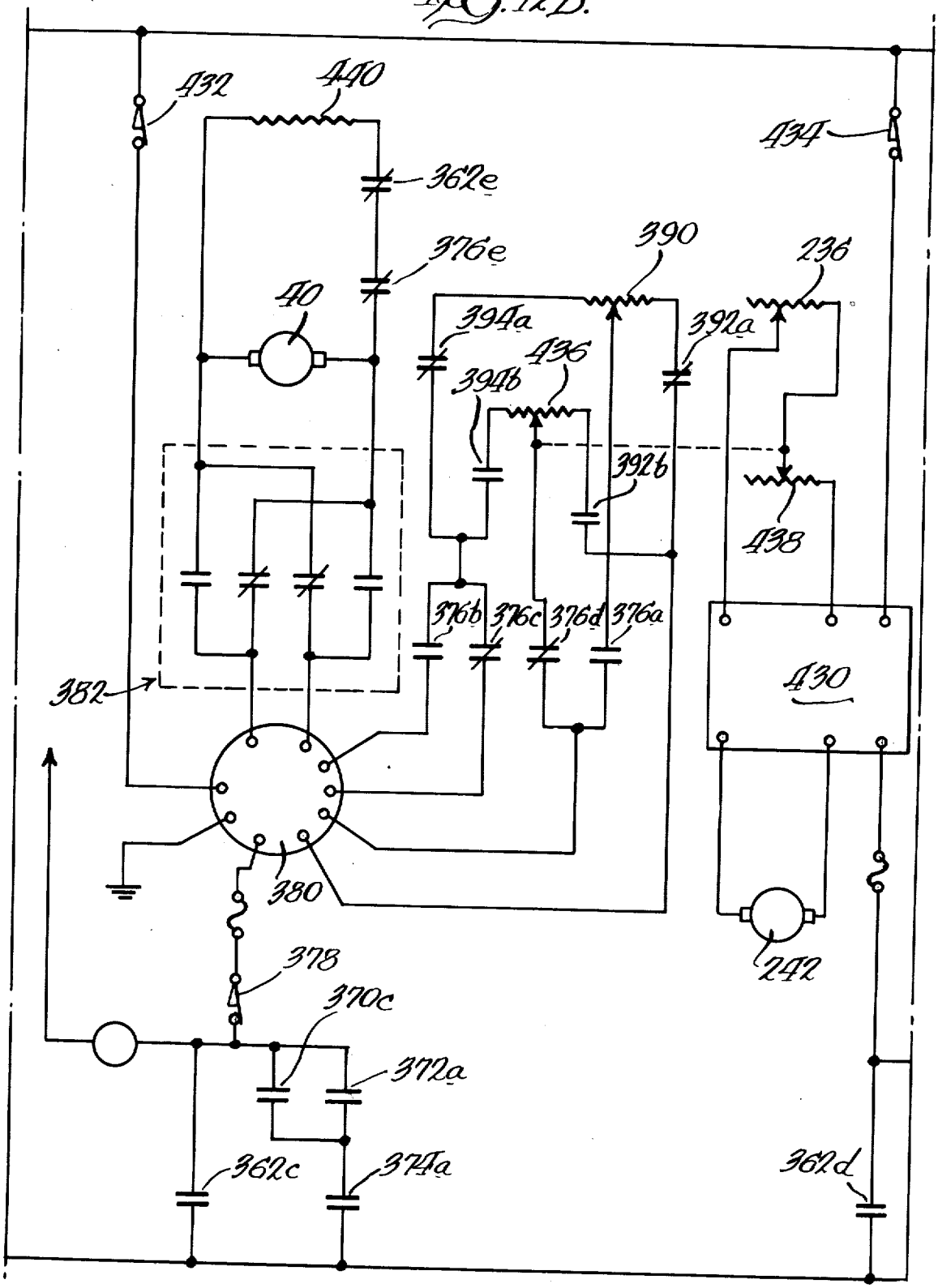
Figure 12C:
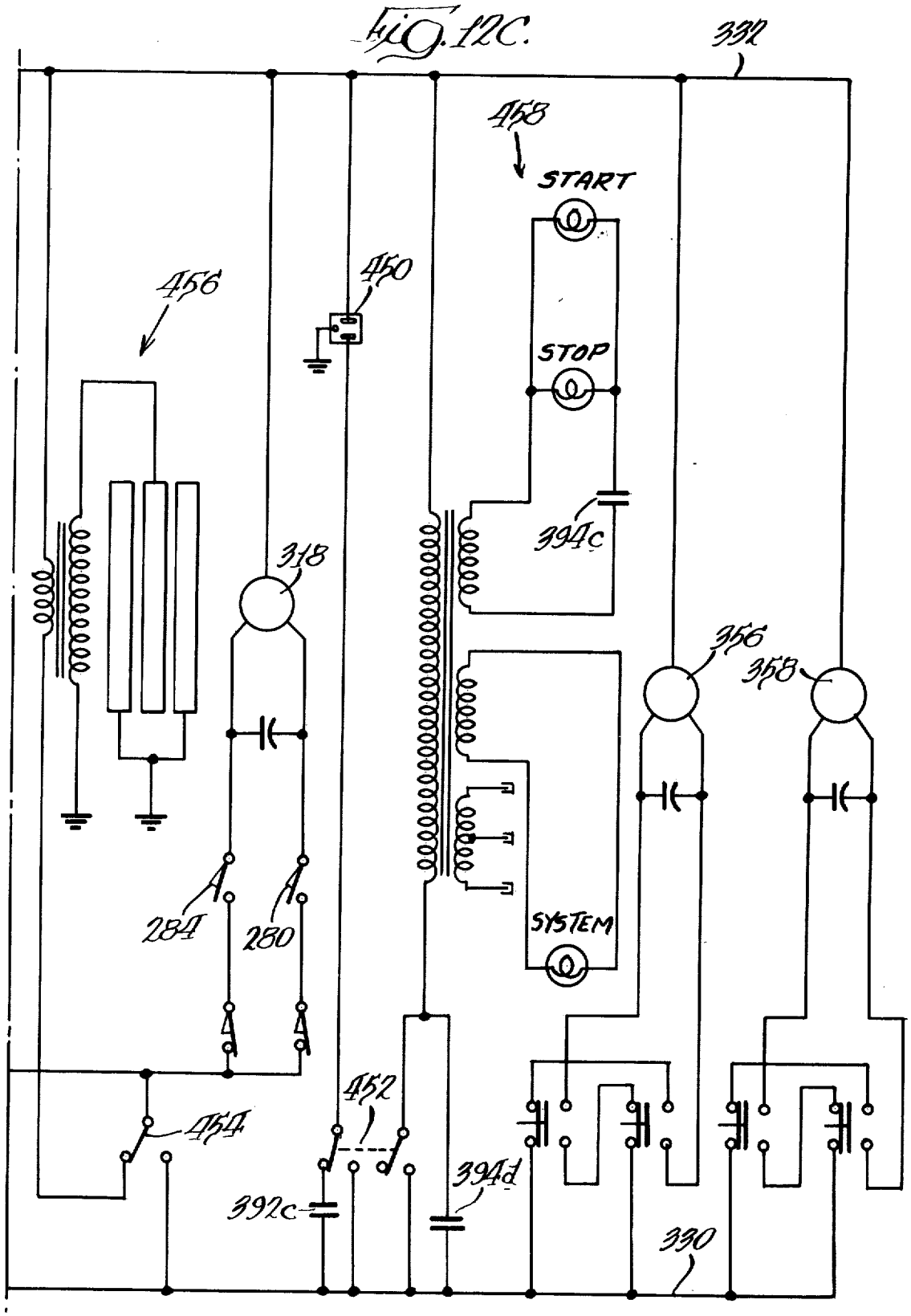

Turning now to FIGS. 12*a* through 12*c*, inclusive, there is illustrated a control schematic for various components of the burster heretofore described. With reference to FIG. 12*a*, lines 330 and 332 are adapted to be connected across a suitable source of alternating current power. The motor 188 is connected across the lines and includes a direction control circuit having a branch 334 directed through a limit switch 336 to normally open contacts 338 of a switch 340 to the normally closed contacts 342 of a switch 344. A second branch 346 passes through a normally closed limit switch 348, through normally open contacts 350 of the switch 344 to normally closed contacts 352 of the switch 340. Assuming both limit switches 336 and 348 are closed indicating that the carriage 184 driven by the motor 188 for accomplishing form length adjustment is not at either end of its path of travel, a change of condition of the switch 340 will cause energization of the motor 188 to drive the carriage in one direction. Conversely, closing of the switch 344, under the same conditions, will cause energization of the motor 188 to drive the carriage in the opposite direction.

Preferably, the switches 340 and 344 are spring loaded to the positions illustrated in FIG. 12*a* and it will be appreciated that there is an interlock between the two branches 334 and 346 whereby both cannot be energized simultaneously.

Turning now to FIG. 12*c*, two reversible motors 356 and 358 are connected across the lines 330 and 332 in identical fashion to the connection of the motor 188. The motors 356 and 358 may be selectively operated through the switches illustrated to adjust the position of the tractor-trimmers 24 laterally of the path of stationery travel to accommodate differing widths of stationery. The means by which energization of the motors 356 and 358 controls the positioning of the tractor-trimmers 28 is described in the previously identified co-pending application of Stromberg, the details of which are herein incorporated by reference.

Returning to FIG. 12*a*, a circuit branch includes a normally closed switch 360 which, as will be seen, is adapted to be momentarily opened to terminate a bursting run. The switch 360, however, has no effect on the ability to adjust the apparatus for differing form lengths, operate the conveyor individually of other parts of the apparatus, or provide for lateral adjustment of the tractor-trimmers. From the switch 360, the circuit branches through normally closed contacts 362*a* operated by a relay 362 to a pair of electrically interlocked switches 364 and 366. Both of the switches 364 and 366 are normally biased to the position schematically illustrated in FIG. 12a and the interlocking is accomplished in the same manner as the interlocking between the switches 340 and 344 described previously. Normally open contacts of the switch 366 are taken through normally closed contacts 368*a* of a relay 368 to a relay 370 and then to the line 332.

The normally open contacts of the switch 364 are taken through normally closed contacts 370*a* operated by the relay 370 to the relay 368 and a parallel relay 372. As will be seen, the switch 364 can be momentarily shifted from the position illustrated to jog the main drive motor 40 in a reverse direction at a relatively low speed while the switch 366 may be momentarily shifted to jog the main drive motor 40 in the forward direction at a slow speed. This is accomplished as follows. Normally open relay contacts 368*b* and 370*b* operated by the relays 368 and 370, respectively, are connected in parallel with each other and in series with the parallel combination of a relay 374 and a relay 376 across the lines 330 and 332. The relay 374 is a time delay relay of conventional construction and once energized will preferably delay approximately one second before changing the condition of its associated contacts.

In any event, upon the shifting of either the switch 364 or the switch 366, but not both, the resultant closure of one of the contacts 368*b* or the contacts 370*b* will result in both of the relays 374 and 376 being energized. With reference to FIG. 12*b*, a circuit branch includes the normally open contacts 374*a* of the time delay relay 374. Such contacts are in series with the parallel combination of normally open contacts 370*c* and 372*a* operated by the relays 370 and 372, respectively. The circuit continues through a normally closed limit switch 378 which may be positioned to be opened when the tray 18 is in its lowermost position to shut off the system. Power may be supplied to an electronic control circuit 380 for the motor 40. Preferably, the control circuit 380 is a so-called "Graham drive" and is of conventional construction. From the Graham drive unit 380, power may be directed to the motor 40 through the circuit elements generally designated 382. The relay contacts of the circuit elements 382 are operated by the relay 372. Thus, assuming the switch 366 is shifted to energize the relay 370, the relay 374 will be energized through contacts 370*b* of the relay 370 and after the time delay, contacts 374*a* will be closed to provide power to the Graham drive unit 380 through the now closed contacts 370*c*. Power will then flow from the Graham drive unit 380 through the circuit elements 382, which will remain in the configuration shown in FIG. 12*b*, to drive the motor 40 in one direction. On the other hand, where the switch 364 closed, the time delay relay 374 will be energized through the relay contacts 368*b*. Power would then flow, after one second, through the contacts 374*a* and the contacts 372*a*, now closed, to the Graham drive unit 380. From the Graham drive unit 380, power would be directed to the motor 40 to drive the same in the opposite direction since the contacts forming the circuit elements 382 will have changed their conditions from those shown in FIG. 12*b* by reason of the simultaneous energization of the relay 372 when the switch 364 was closed.

As generally alluded to previously, it is desirable that when the main drive motor 40 is jogged in either direction, it be at a relatively low speed to avoid injury to the operator. To this end, a speed control potentiometer 390 has its wiper connected to the Graham drive unit through normally open contacts 376*a* operated by the relay 376 and its ends also connected to the Graham drive unit 380. One end is connected via the normally closed contact 392*a* of a relay 392 while the other end is connected through the normally closed contacts 394*a* of a relay 394 through either normally open contacts 376*b* or normally closed contacts 376*c* of the relay 376. As will be seen, when the motor 40 is jogged, the contacts 392*a* and 394*a* remain closed while the contacts 376*a* and 376*b* will close in response to energization of the relay 376 through either the contacts 370*b* or 368*b*. Consequently, the potentiometer 390, depending upon the position of adjustment of its wiper, will provide an electrical speed control signal to the Graham drive unit 380 which will be such that the motor 40 will be energized during the jogging only at a relatively low rate of speed.

Returning to FIG. 12*a*, a normally open switch 400 is provided in series with the switch 360. It in turn is directed through the normally closed contacts 374*b* of the time delay relay 374 to a junction 402 to which the relays 392 and 362 are connected. In addition, a relay 404 is connected across the line 332 to the junction 402.

Upon closing of the switch 400, and assuming the time delay relay 374 has not been energized, power will be applied to the relays 362, 392 and 404. The relays 392 and 404 will energize immediately while the relay 362 may energize assuming that contacts 406 operated by the jam detector 260 are closed (indicating no jam) a switch 408 is closed designating that the knob 80 has been shifted to a position to decouple the same from the shaft 64 and the switch 324 is closed designating that the cover is fully closed. Upon the energization of the relay 362, switch contacts 362*a* in the jog circuit will be open to preclude operation of the jog circuit. At the same time, normally open contacts 362*b* will close to establish a holding circuit across the switch 400, the holding circuit including normally closed contacts 410*a* of a time delay relay 410.

Referring now to FIG. 12*b*, normally open contacts 362*c* will be closed to establish a path of power to the Graham drive unit 380 whereby power will be directed to the motor 40 through the circuit elements 382 which will retain the configuration illustrated in FIG. 12*b* as they are operated only during operation of the jog circuit. Consequently, the motor 40 can be energized to drive the apparatus in but a single direction upon closure of the switch 400.

The motor 40 will remain energized until such time as the switch 360 is momentarily opened breaking the holding circuit for the relay 362. Alternately, the circuit may be de-energized if the jam detector 260 determines that a jam exists through the opening of the contacts 406. Finally, if an attempt is made to open the cover 22 during operation, the switch 324 will open to halt operation.

It will also be observed that operation of the motor 40 can be terminated upon opening of the limit switch 378 indicating that the stacking tray 18 has reached its lowermost position.

In addition, the motor 40 can be shut off upon changing condition of the actuators 322 for the last form switches 320. The last form detecting switches 320 are connected in series with each other to a relay 412 and to a relay 410 in parallel with the relay 412 through normally open contacts 412*a* operated by the relay 412.

Both of the relays 410 and 412 are time delay relays of the type that will, after being energized for approximately 10 seconds, cause their respective contacts to change condition from that illustrated.

It will also be recalled that the switches 320 are normally maintained open by stationery and closed only when stationery is no longer present in the stationery path. Assuming such an occurrence, both of the switches 320 will close to cause energization of the relay 412. After approximately 10 seconds, the contacts 412*a* will close to energize the relay 410. After an additional 10 seconds, the latter will open the contacts 410*a* forming part of the holding circuit for the relay 362 thereby de-energizing the motor. The purpose of the time delay is to provide sufficient time to enable all forms to clear the bursting section 32 and the conveyor 34 to be stacked on the tray 18.

It will be recalled that the conveyor is driven by separate motor 242 and when the burster is operating continuously in response to momentary closure of the switch 400, the motor 242 should also be energized. Consequently, contacts 362*d* which are normally open and operated by the relay 362 are connected to a power unit 430 for the motor 242. Thus, the motor 242 will be energized at least whenever the motor 40 is energized.

In this respect, it is sometimes desirable to terminate operation of the apparatus when used in line with other equipment. Switches 432 and 434 may be employed in the circuit of both the Graham drive unit 380 and the power unit 430 and are responsive to movement of the bale 326. When the bale moves upwardly indicating that the burster is processing the forms faster than the upstream machines, the switches 432 and 434 will open to stop both the conveyor and the burster components without altering circuit conditions until the upstream equipment can "catch up". This will be indicated by a return of the bale to its usual position and the resultant closure of the switches 332 and 334 to re-energize the apparatus.

A speed control potentiometer 436 is provided for the motor 40 and is electrically coupled to the Graham drive unit 380 through the closure of normally open contacts 392*b* and 394*b* operated by the relays 392 and 394 which are energized at this time. At the same time, the jog speed control potentiometer will be decoupled by reason of simultaneous opening of the normally closed contacts 392*a* and 394*a*.

The position of the wiper 436 may be manually controlled for speed control purposes by means of a knob or the like and is operative to control the speed of the motor 40 when the apparatus is being operated continuously. The arrangement is such that very high rates of speed can be obtained as desired.

The wiper of the potentiometer 436 is also mechanically coupled to the wiper of a speed control potentiometer 438 associated with the speed control and power unit 430 for the conveyor motor 242. The wiper of the potentiometer 438 is connected to the potentiometer 236 which, it will be recalled, has its wiper positioned responsively to the form length adjustment system.

In order to maintain proper shingled relation of the individual forms on the conveyor, it is necessary that there not be a straight line correlation between speed of the burster and speed of the conveyor. Consequently, the circuit arrangement between the potentiometers 438 and 236 is such as to establish the proper relationship.

It is also desirable to provide means whereby coasting of the burster components driven by the motor 40 is minimized. To this end, a resistor 440 having a high power rating is connected in series with normally closed contact 362*e* operated by the relay 362 and normally closed contact 376*b* be operated by the relay 376.

When the system is operating continuously, and the same is stopped by any of the previously mentioned occurrences, the relay 362 will de-energize thereby closing contact 362*e*. At the same time, the relay 376 will have been de-energized so that the motor 40 is placed into shunt relationship with the resistor 440. The motor 40 is preferably of the type that can act as a generator with the result that regenerative breaking action is established to rapidly bring the system to a halt.

The system also includes an electrical outlet 450 connected to one side of a double pole double throw switch 452. When the switch 452 is in the position illustrated in FIG. 12*c*, and the burster is running continuously, power will be applied to the outlet through the then closed contacts 392*c* operated by the relay 392. When the switch 352 is in the opposite position, power will always be applied to the outlet 450. The purpose of this circuitry is to allow upstream business processing equipment to be connected to the outlet 450 to receive power therefrom thereby allowing some degree of control of such upstream equipment through the burster control switches previously described.

Also provided is a switch 454 having its common contact connected to the junction of the power unit 430 for the conveyor and the contacts 362*d*. When the switch 454 is in the position shown, it will convey power, upon energization of the main burster motor 40 for continuous operation, to a static eliminater, generally designated 456 of conventional construction. When the switch 454 is moved to its other position, power may be applied directly to the conveyor 30 allowing the latter to be driven independently of other system parts.

Also provided is an indicating circuit, generally designated 458 for lamps providing various indication functions.

I claim:

1. A burster for separating continuous forms stationery assemblies into individual form lengths, comprising: means defining a path of stationery travel through said burster and including an infeed and an outfeed end; bursting means intermediate said infeed end and said outfeed end and along said path of stationery travel for receiving continuous forms assemblies and separating the same into individual form lengths; a housing containing said bursting means and said stationery travel path defining means and including an openable cover including a member slidably mounted on said housing whereby when said cover is opened, access to said bursting means and said stationery travel path defining means may be had; a removable imprinter assembly received within said housing along said stationery path between said infeed end and said bursting means for imprinting selected information on continuous business forms prior to their being received by said bursting means; latch means for latching said printing means within said housing; and manually operable handles secured to said latch means and movable to a position within the path of movement of said member when said latch means are in an unlatched condition and to be engaged by said member when said member is moved to a closed position to move said latch means into latching engagement with said housing.

2. A burster according to claim 1 wherein said printing means includes a frame mounting a printing roller, said frame further removably mounting an inking assembly; additional latch means for latching said inking assembly to said frame, said additional latch means including means actuable to lock said inking assembly to said frame upon closing of said cover.

3. A burster according to claim 1 including motor means for driving said bursting means, and means for precluding energization of said motor means when said cover is open.

* * * * *